US005713512A

United States Patent [19]

Barrett

[11] Patent Number: 5,713,512

[45] Date of Patent: Feb. 3, 1998

[54] POLYMERIC INSULATED CONTAINER

[75] Inventor: Robert K. Barrett, Mississauga, Canada

[73] Assignee: Polytainers, Inc., Ontario, Canada

[21] Appl. No.: 706,797

[22] Filed: Sep. 3, 1996

[51] Int. Cl.[6] ..... B65D 3/22

[52] U.S. Cl. ..... 229/403; 220/469; 229/400

[58] Field of Search ..... 229/4.5, 400, 403; 220/415, 416, 468, 469

[56] References Cited

U.S. PATENT DOCUMENTS

| | | | |
|---|---|---|---|
| 1,679,621 | 8/1928 | Myers . | |
| 1,771,765 | 7/1930 | Benson | 229/403 |
| 2,266,828 | 12/1941 | Sykes | 229/403 |
| 2,563,352 | 8/1951 | Morse . | |
| 2,661,889 | 12/1953 | Phinney | 229/403 |
| 2,905,350 | 9/1959 | Edwards . | |
| 3,126,139 | 3/1964 | Schechter . | |
| 3,203,611 | 8/1965 | Anderson et al. . | |
| 3,372,830 | 3/1968 | Edwards . | |
| 3,443,715 | 5/1969 | Edwards | 220/469 |
| 3,456,860 | 7/1969 | Janninck . | |
| 3,797,369 | 3/1974 | Amberg . | |
| 3,908,523 | 9/1975 | Shikaya . | |
| 4,261,501 | 4/1981 | Watkins et al. | 220/469 |
| 4,456,134 | 6/1984 | Cooper . | |
| 4,492,313 | 1/1985 | Touzani . | |
| 4,534,391 | 8/1985 | Ventimiglia et al. . | |
| 4,890,757 | 1/1990 | Robbins, III . | |
| 5,067,622 | 11/1991 | Garver et al. . | |
| 5,071,060 | 12/1991 | DeFelice | 229/403 |
| 5,076,463 | 12/1991 | McGraw . | |
| 5,092,185 | 3/1992 | Zornes et al. . | |
| 5,092,485 | 3/1992 | Lee . | |
| 5,145,107 | 9/1992 | Silver et al. . | |
| 5,205,473 | 4/1993 | Coffin, Sr. . | |
| 5,217,128 | 6/1993 | Stenger . | |
| 5,226,585 | 7/1993 | Varano . | |
| 5,363,982 | 11/1994 | Sadlier . | |
| 5,385,260 | 1/1995 | Gatcomb . | |
| 5,547,124 | 8/1996 | Mueller | 229/403 |

FOREIGN PATENT DOCUMENTS

| | | | |
|---|---|---|---|
| 40/5004670 | 1/1993 | Japan | 229/403 |

*Primary Examiner*—Gary E. Elkins
*Attorney, Agent, or Firm*—Arnold, White & Durkee

[57] ABSTRACT

A polymeric cup adapted to hold foods and to receive a sheath with a substantially smooth exterior surface to form an insulated container is set forth. The substantially smooth exterior surface allows for the displaying of printed material. The polymeric cup includes a side wall with an outer surface and a base connected to a lower portion of the side wall. A plurality of ribs project radially outward from the outer surface of the side wall and axially extend substantially along the entire length of the side wall. The ribs are uniformly distributed around substantially the entire circumference of the side wall. Each of the ribs has a face with a circumferential width and is separated from an adjacent one of the ribs by a predetermined distance. The predetermined distance is less than approximately 0.100 inch and the ratio of the circumferential width to the predetermined distance is in the range from about 0.15 to about 1.0.

22 Claims, 5 Drawing Sheets

POLYMERIC INSULATED CONTAINER

FIELD OF THE INVENTION

The present invention relates generally to disposable and reusable containers and, in particular, to an improved type of insulated container for holding and serving food.

BACKGROUND OF THE INVENTION

Food, including beverages, are often placed in disposable or reusable containers during the packaging process. In some cases, the consumer heats the food within the container before removing the food. For example, packaged dry soups are hydrated with boiling water or hydrated with cold water and heated in a microwave oven, and then eaten directly from the package. In other cases, after heating the food in the container, the consumer removes the heated food to a serving dish for subsequent consumption. Alternatively, some packaged contents, such as ice cream or yogurt, are refrigerated prior to consumption. In situations where it is desirable for the contents of the container to remain at a temperature other than the temperature of the ambient environment, it is advantageous to provide a package with thermally insulating characteristics.

Air is an excellent insulator. Known packages utilize an air space between the inner wall of the package contacting the contents of the package and the ambient environment. Some of these packages utilize a double-wall configuration to provide an air gap. For example, many disposable coffee cups employ this configuration. However, these types of packages often require extra materials in that they use two entire cups to provide the air gap.

Another known paper cup has internally-projecting ribs on the interior of a sheath that wraps around a cup. The ribs act as embossments to provide an air gap between the sheath and the cup. However, the exterior surface of the sheath appears beveled which causes the printed material to be distorted. Consequently, the printed material is difficult to read. Also, the sheath is corrugated to produce the ribs such that its thickness at the ribs is approximately the same as its thickness between the ribs. The thickness of wall of the cup remains constant throughout its circumference. Thus, heat is readily conducted through the thin walls of the sheath and the cup assembly between the insulating air gaps and exchanged with the ambient environment.

In addition to the problems described above; paper containers are also susceptible to punctures and leakage at their seams although they may have double walls. In addition, typical paper containers can sustain only a small vertical force before buckling. Thus, paper containers filled with food cannot be stacked very high shipping, storage, or display. Furthermore, if the paper is not sealed well, the container will become soggy and lose its ability to hold the food. This problem of sealing is aggravated when the food and the container are heated as when placed in a microwave oven.

Therefore, a need exists for an insulative container that exhibits substantial strength and resists puncturing and leaking. The amount of beveling on the exterior surface of the container should be minimized so that the overall appearance is aesthetically pleasing and the printed material thereon is not distorted.

SUMMARY OF THE INVENTION

The present invention provides for a ribbed polymeric cup that is adapted to receive a sheath and form an insulated container for foods and beverages. The sheath has an exterior surface that is substantially smooth around the polymeric cup so that printed material can be placed thereon. Thus, the sheath may also serve as a label.

The polymeric cup typically has a frustoconical shape defined by its side wall. The cup includes a base that is connected to a lower portion of the side wall along its inner surface. A plurality of ribs project radially outward from the outer surface of the side wall and extend substantially along the axial length of the polymeric cup. Each of the ribs has an outer face against which the sheath is disposed. The regions encompassed by adjacent ribs, the interior surface of the sheath, and the outer surface of the side wall provide for thermally insulative gaps. Thus, the insulative container produced from the polymeric cup and sheath assembly has a series of insulative regions along the axial length of the cup.

In addition to the thermally insulative gaps defined between the ribs, the insulative container also has a substantial thermal resistance through the ribs due to the fact that the thickness of the side wall remains constant. In the regions through the ribs, the thermal path from the interior of the side wall to the ambient environment includes the thickness of the side wall, the radial thickness of the rib, the thickness of the adhesive which attaches the sheath to the rib, if an adhesive is used, and the thickness of the sheath. Consequently, the heat exchanged between the food contained in the insulative container and the ambient environment must travel either through the insulative gaps in the previous paragraph or through this highly-resistive thermal path though the ribs. Thus, heat is transferred at a lower rate and, therefore, the rate of temperature change of the food contained within the polymeric cup is reduced. Also, the large thermal resistance allows the consumer to grasp the insulative container when the food contained therein is hot without the risk of injury.

To provide an insulated container with a substantially smooth exterior surface, the geometry of the fibs on the polymeric cup is important. In one preferred embodiment when using a polymeric label, each of the ribs is distanced from an adjacent rib by a predetermined distance known as a gap width that is usually less than about 0.060 inch and typically in the range from about 0.040 inch to about 0.050 inch. In another preferred embodiment when the label is made of paper, the predetermined distance is usually less than about 0.100 inch and typically in the range from about 0.040 inch to about 0.070 inch. These values may vary depending on the material, the thickness of the sheath, the height of the container, and the length of the ribs.

BRIEF DESCRIPTION OF THE DRAWINGS

Other objects and advantages of the invention will become apparent upon reading the following detailed description and upon reference to the drawings in which.

Figure 1:
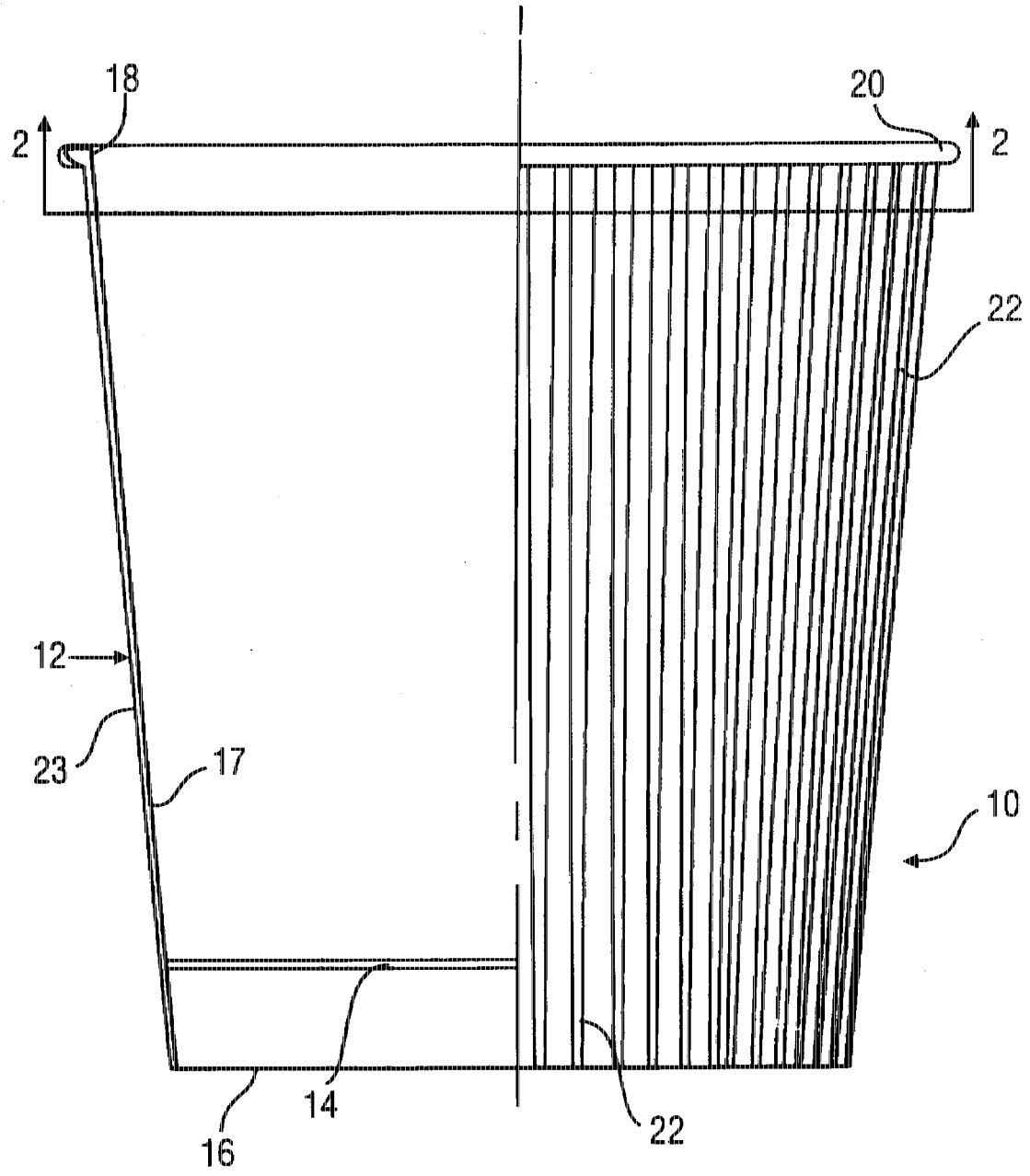
FIG. 1 is a side view of a polymeric cup, partially broken away, that is assembled into the insulated container.

While the invention is susceptible to various modifications and alternative forms, a specific embodiment thereof has been shown by way of example in the drawings and will herein be described in detail. It should be understood, however, that it is not intended to limit the invention to the particular forms disclosed. To the contrary, the intention is to cover all modifications, equivalents, and alternatives falling within the spirit and scope of the invention as defined by the appended claims.

DETAILED DESCRIPTION OF THE INVENTION

Referring initially to FIG. 1, a polymeric cup 10 is illustrated in a side view with a portion of the cup 10 broken away. The cup 10 includes a side wall 12 which extends generally in the vertical direction. The side wall 12 defines the frustoconical shape of the polymeric cup 10. A base 14 is connected to a lower portion of the side wall 12 and is usually integral with the side wall 12. The base 14 is typically circular and located above the lowermost edge 16 of the side wall 12.

At an uppermost edge 18 of the side wall 12 is a lip portion 20. The lip portion 20 is rounded which allows beverages in the polymeric cup 10 to be easily poured therefrom. If beverages are placed in the cup 10, then the rounded shape of the lip portion 20 does not present a sharp edge which could lacerate the mouth of the consumer. The rounded lip portion 20 also serves as a flange which is captured by a lid or flexible membrane after food are placed therein. It should be noted that the term "food" is used generically to include any solid food, powdered food, liquid food (e.g. soups), and hot and cold beverages.

A plurality of ribs 22 are connected to an outer surface 23 of the side wall 12 and extend along the axial length of the cup 10. Typically, the ribs 22 are uniformly distributed around the outer surface 23 of the side wall 12 and define a series of uniformly-spaced gaps between the ribs 22.

The polymeric cup 10 can be made of various materials which exhibit good strength and a resistance to high temperatures. These materials must also be capable of being subjected to energy produced by a microwave oven. For example, polypropylene or high density polyethylene may be used. If the use of the cup 10 is in an insulated container that contains cold foods like yogurt or ice cream, then the polymeric cup may be also made of high density polyethylene or copolymer polypropylene which provides good resistance to freezing without the risk of fracturing.

Figure 2:
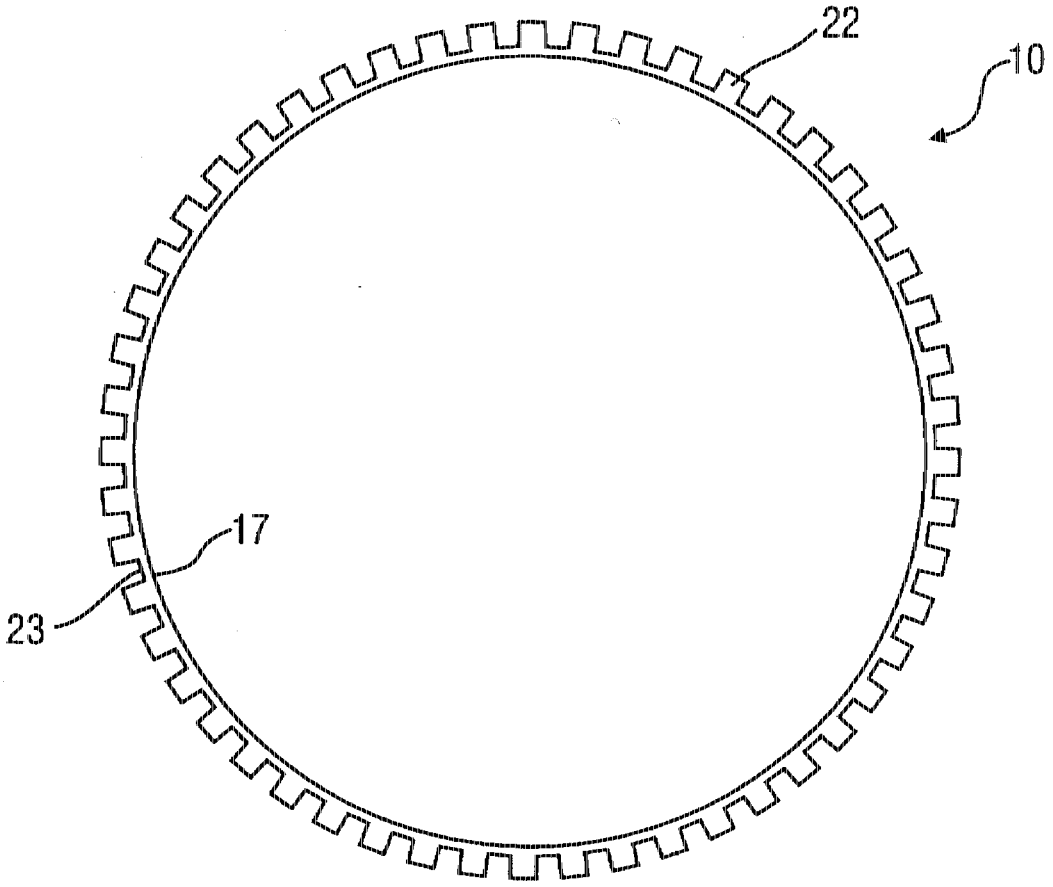
FIG. 2 is a cross-sectional view of the polymeric cup of FIG. 1 taken along line 2—2.

FIG. 2 is a cross-sectional view of the polymeric cup 10 taken along line 2—2 in FIG. 1. The ribs 22 extend radially outward from the outer surface 23 of the side wall 12. Each of the ribs 22 generally has a rectangular-shaped cross-section such that its face 28 is flat or planar. Alternatively, the ribs 22 may have a curved distal end such that its face 28 is curved.

The ribs 22 add rigidity to the polymeric cup 10. This allows for the cups 10 to be stacked when lids are placed thereon while reducing the chance of any buckling due to the vertical loading. Additionally, the ribs 22 provide resistance to any torsion loading of the cup 10. Furthermore, because the cup 10 is made of a polymer, it is much more resistant to any punctures than can occur in paper cups. Consequently, the polymeric cup 10 is of a structurally-sound, monolithic design.

Figure 3:
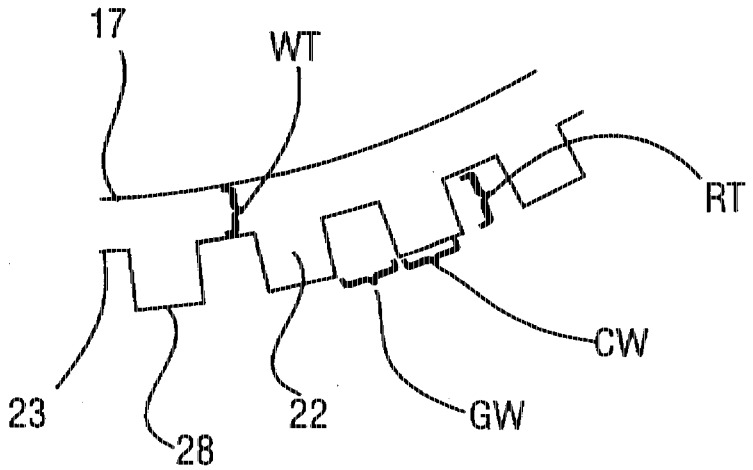
FIG. 3 is an expanded cross-sectional view of a portion of the polymeric cup in FIG. 2.

FIG. 3 illustrates an expanded view of the ribs 22 and the cup. The cup has a wall thickness WT which is the distance between the interior surface 17 and the exterior surface 23. The face 28 of each of the ribs 22 has a circumferential width CW. Each of the ribs 22 has a radial thickness RT which is the distance between the face 28 and the outer surface 23. Furthermore, adjacent ribs 22 are separated by a predetermined distance known as a gap width GW. The ribs 22 may have a constant circumferential width CW along the entire length of the polymeric cup 10 such that the gap width GW between adjacent ribs 22 is greater near the uppermost edge 18 than at the lowermost edge 16 of the side wall 12. Alternatively, the ribs 22 may taper such that they have a larger circumferential width CW near the uppermost edge 18 and the gap width GW between adjacent ribs 22 remains constant along the entire length. For example, in one embodiment, the circumferential width CW of the ribs 22 tapers from about 0.035 inch near the uppermost edge 18 to about 0.015 inch near the lowermost edge 16.

The values of the radial thickness RT, the circumferential width CW, the gap width GW, and the wall thickness WT dictate the ability of the cup 10 to provide insulative characteristics when assembled into the insulative container that is discussed below with reference to FIGS. 5 and 6. The wall thickness WT is typically about 0.010 inch to about 0.020 inch. The gap width GW is less than approximately 0.100 inch and usually in the range of about 0.040 inch to about 0.060 inch. The ratio of the circumferential width CW to the gap width GW of each rib 22 is usually in the range from about 0.2 to about 1.0. The ratio of the radial thickness RT to the circumferential width CW is generally in the range from about 0.25 to about 4.0. Again, these values vary depending on the material of the sheath, the thickness of the sheath, the height of the container, and the length of the ribs.

Figure 4:
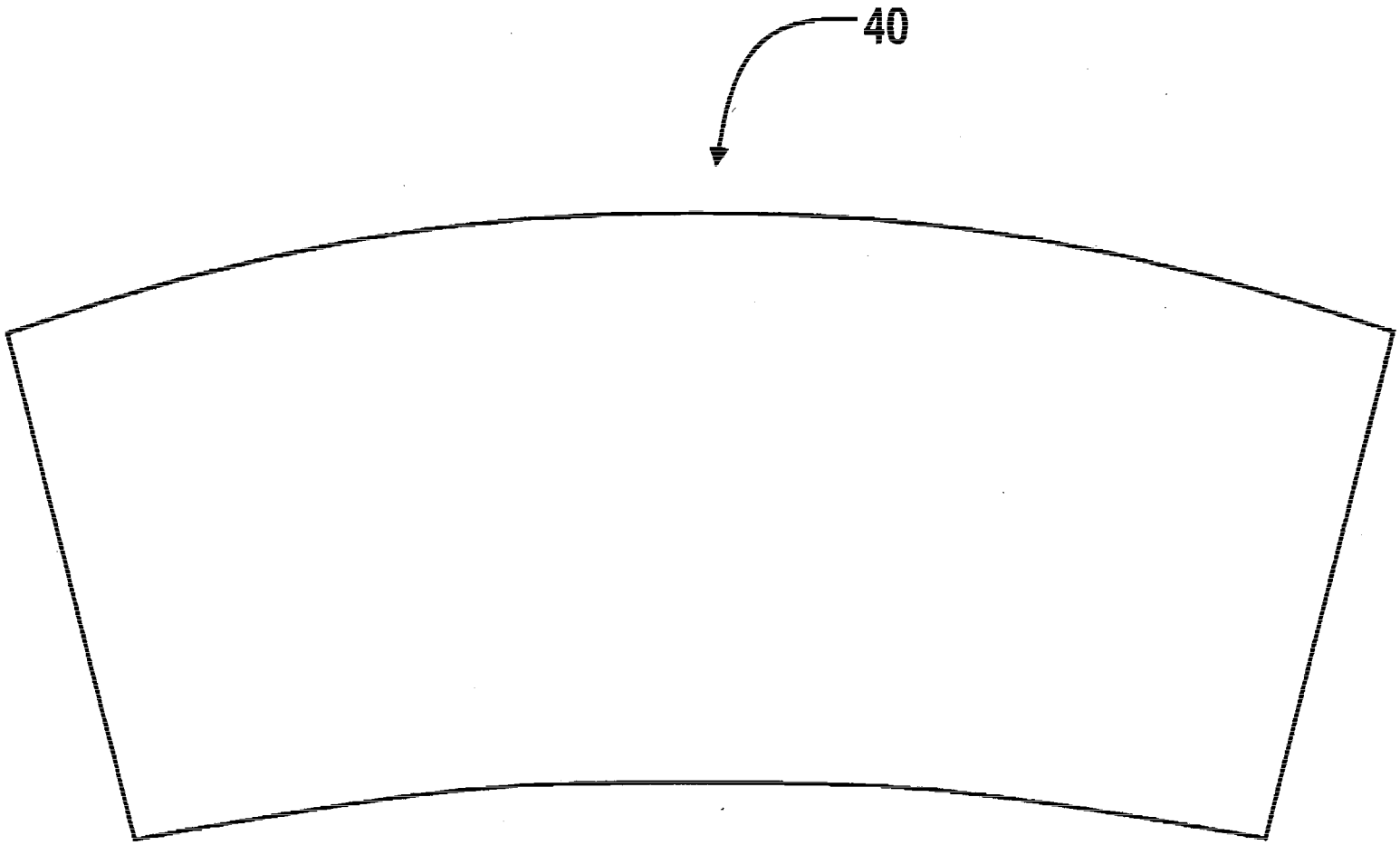
FIG. 4 is top view of the outer sheath that is used in the insulated container.

FIG. 4 illustrates a sheath 40 which fits around the cup 10 to form an insulative container. As is apparent from the unwrapped sheath 40, the shape of the sheath 40 accommodates the frustoconical shape of the cup 10. The sheath 40 is generally made from a polymer or from fibrous material such as paper. The thickness of the sheath 40 typically ranges from about 0.002 inch to about 0.015 inch depending on the material used in the sheath 40. The sheath 40 generally carries printed material. Therefore, it also acts as a label. Another function of the sheath 40, discussed in further detail with reference to FIG. 6, is that it closes off the regions between adjacent ribs 22 of the cup 10 to form the thermally insulative gaps.

The sheath 40 may be attached by use of numerous adhesives such as various hot and cold melt adhesives, heat-activated adhesives, and pressure sensitive adhesives. The sheath 40 may also be attached to the cup 10 through pressure sensitive films made from, for example, oriented polypropylene or oriented polystyrene. These pressure sensitive films may utilize adhering agents such as polyisobutylene to enhance their ability to adhere to the cup 10. Another method of attaching the sheath 40 employs a shrink wrap film which fits loosely around the cup 10 initially, but gathers tightly around the cup 10 after being heated. A common example of a material used as a shrink wrap film is polyvinyl chloride (PVC).

Figure 5:
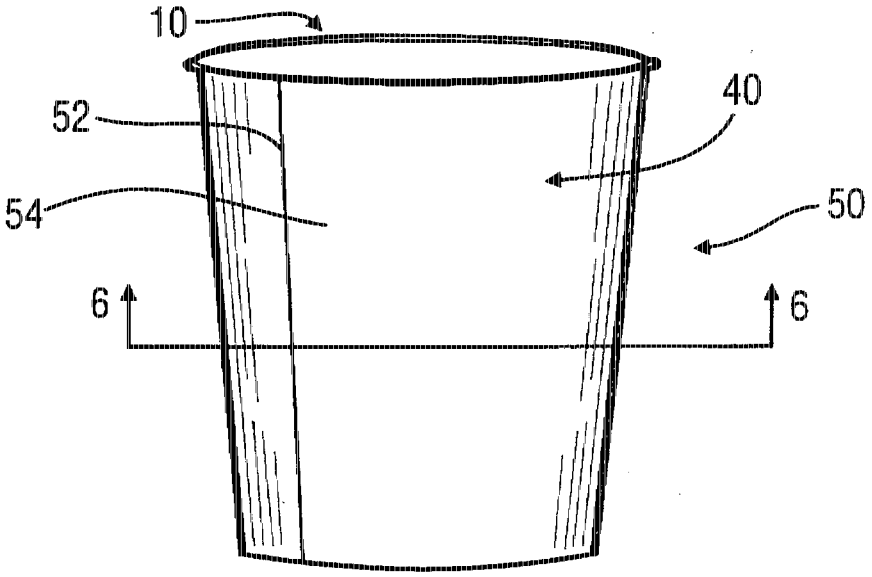
FIG. 5 is a side view of the insulated container shown with one outer sheath.

FIG. 5 illustrates a thermally insulative container 50 formed by the cup 10 with the sheath 40 wrapped therearound. The insulative container 50 generally contains foods which require heat before serving such as soups, chili, hot beverages, pastas, etc. The insulative container 50 can also be used for cold foods such as ice cream, yogurt, frozen fruits, and cold beverages.

The sheath 40 overlaps at a seam 52 such that it tightly surrounds the cup 10 as shown in FIG. 5. The ends of the sheath may also meet, but not overlap, to produce a seam. The exterior surface 54 of the sheath 40 is substantially smooth to display the printed material that is placed thereon. Because the beveling of the exterior surface of the sheath 40 is minimized, the printed material on the substantially smooth exterior surface of the sheath 40 (acting as a label) is displayed in an aesthetically pleasing manner. Furthermore, it is much easier for the consumer to read. Although only one sheath 40 is shown, multiple sheaths can be wrapped around cup 10.

Figure 6:
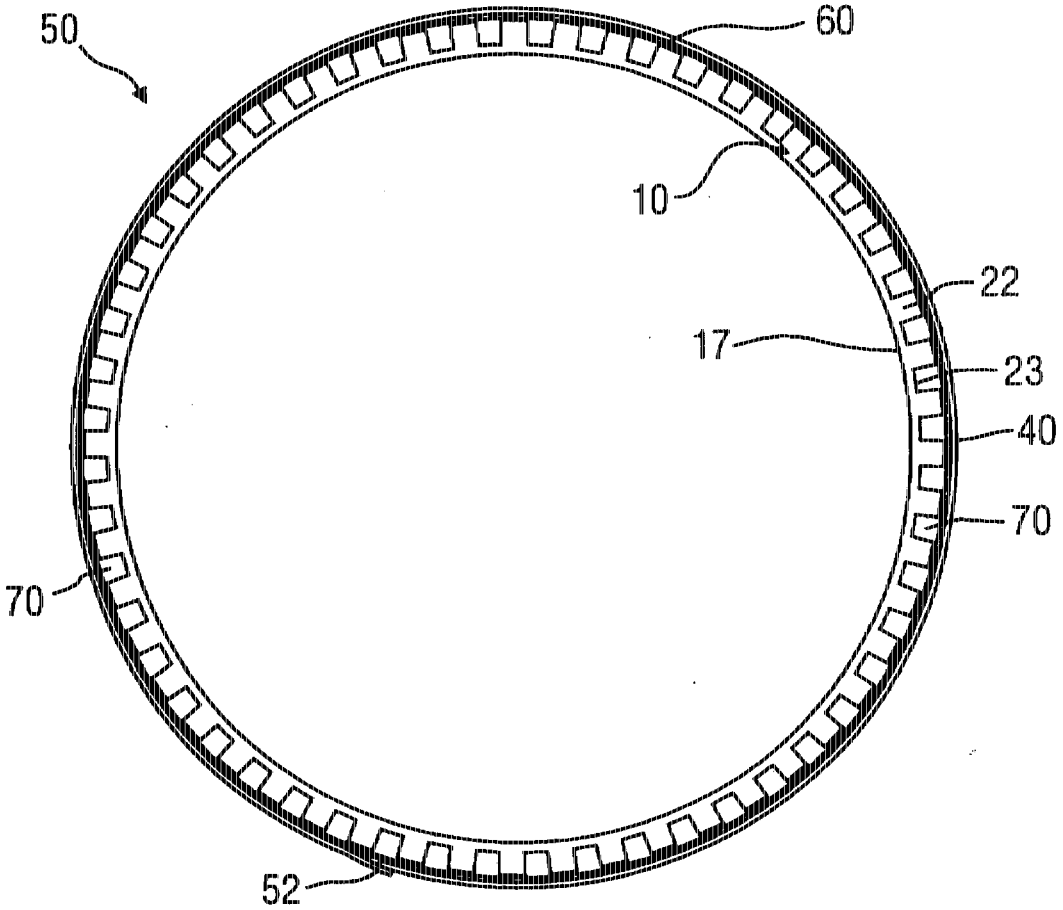
FIG. 6 is a cross-sectional view of the insulated container of FIG. 5 taken along line 5—5.

FIG. 6 illustrates the cross section of the insulative container 50 taken along line 6—6 in FIG. 5. The sheath 40 is attached to the cup 10 by a layer 60 of material that is used to attach the face 28 of the fibs 22. As stated previously, the materials used at this layer 60 include various materials that bond the sheath 40 to the cup 10 such as hot melt adhesives, cold melt adhesives, pressure sensitive adhesives, heat-activated adhesives, etc. And, layer 60 may not be present if shrink wrap methods are employed or if pressure sensitive films or labels are used.

The regions between adjacent ribs 22, the interior surface of the sheath 40, and the outer surface 23 of the polymeric cup form a series of thermally insulative gaps 70. These gaps 70 serve two primary functions. First, they help to maintain the temperature of the food contained therein at its original temperature by reducing the rate that heat is exchanged with the ambient environment. And second, they allow the consumer of the product to grasp the insulative container 50 when hot foods are present within the insulative container 50.

To achieve the two main objectives of providing a thermally insulative container and a substantially smooth exterior surface 54 adapted to receive printed material, the spacing between the ribs 22 is important. For example, when the sheath 40 is made of a polymer such as oriented polypropylene with a thickness from about 0.001 inch to about 0.004 inch, the gap width GW is approximately 0.050 inch and the circumferential width CW on the face 28 of the ribs 22 is approximately 0.015 inch to about 0.035 inch. This ensures that the beveling of the exterior surface 54 of the sheath 40 around the insulative container 50 is minimized, or possibly eradicated.

Likewise, when the sheath 40 is made of fibrous material such as paper with a thickness of approximately 0.002 inch to about 0.004 inch, the gap width GW between adjacent ribs 22 can be as large as about 0.100 inch while the circumferential width CW ranges from about 0.015 inch to about 0.035 inch to minimize beveling. However, the gap width GW is usually kept from about 0.050 to about 0.060 inch.

The thermally insulative gaps 70 provide a substantial thermal resistance to reduce the heat exchanged between the food within the cups 10 and the ambient environment. Furthermore, the insulative container 50 also has a substantial thermal resistance between the thermally insulative gaps 70 due to the fact that the wall thickness WT of the side wall 12 (FIG. 3) remains constant (i.e. the interior surface 17 has a constant diameter). In the regions outside the thermally insulative gaps 70, the thermal path from the interior surface 17 of the side wall 12 to the ambient environment includes the wall thickness WT of the side wall 12 (FIG. 3), the radial thickness RT of the rib 22 (FIG. 3), the thickness of the adhesive 60 which attaches the sheath 40 to the ribs 22, and the thickness of the sheath 40. Consequently, the only way for heat to be transferred other than through the thermally insulative gaps 70 is by being conducted through the thermal path described above which has a substantial amount of thermal resistance. Thus, heat is exchanged between the food in the insulative container 60 and the ambient environment at a low rate. Therefore, the rate of temperature change for the food contained within the insulative container 60 is reduced. Also, the large thermal resistance allows the consumer to grasp the container when the food contained therein is hot without the risk of injury.

Figure 7:
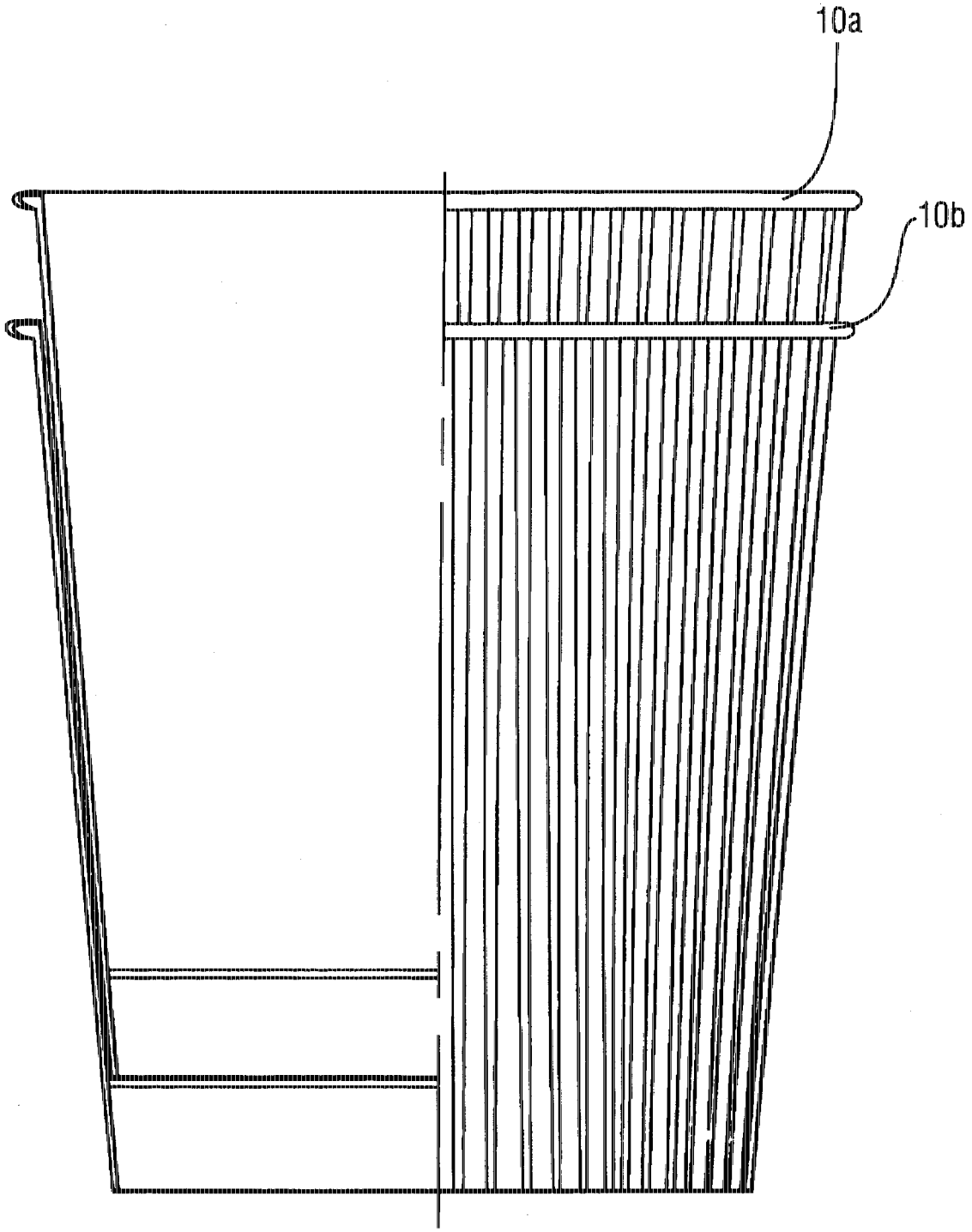
FIG. 7 is a side view of two polymeric cups, partially broken away, that are nestled together.

FIG. 7 illustrates a first polymeric cup 10*a* nestable inside of a second polymeric cup 10*b* which is obtained through the use of a frustoconical shape. The nestable cups 10*a* and 10*b* engage one another at their bases or at their upper lip portions. Thus, the cups 10 can be easily stacked and stored in a minimal amount of space. Furthermore, once the sheath 40 is placed around the cups 10 to form the insulative containers 50, the frustoconical shape stills allows the insulative containers 50 to be nestable within each other.

Each of these embodiments and obvious variations thereof is contemplated as failing within the spirit and scope of the invention, which is set forth in the following claims.

What is claimed is:

1. An insulated container for holding food, comprising:

a frustoconical polymeric cup having a side wall with an outer surface, a base connected to a lower portion of said side wall, and a plurality of ribs projecting radially outward from said outer surface of said side wall, said plurality of ribs axially extending substantially along the entire length of said side wall and being distributed around substantially the entire circumference of said side wall, each of said plurality of ribs having a face with a circumferential width and being separated from an adjacent one of said plurality of ribs by a predetermined distance, said predetermined distance being less than approximately 0.060 inch and the ratio of said circumferential width to said predetermined distance being in the range from about 0.2 to about 1.0;

a polymeric sheath having an exterior surface with printed material thereon and an interior surface being connected to at least one of said faces of said plurality of ribs, said exterior surface of said sheath being at least substantially smooth after being attached to said plurality of ribs for displaying said printed material; and a plurality of thermally insulative gaps formed by adjacent ones of said plurality of ribs, said interior surface of said sheath and said outer surface of said side wall.

2. The insulated container of claim 1, wherein one of said insulated containers is nestable within another of said insulated containers.

3. The insulated container of claim 1, wherein said face of each of said plurality of ribs is planar.

4. The insulated container of claim 1, said sheath is attached to said plurality of ribs via an adhesive.

5. The insulated container of claim 1, wherein said sheath has a thickness in the range from about 0.001 inch to about 0.004 inch, said predetermined distance being approximately 0.050 inch and said circumferential width being in the range from about 0.15 inch to about 0.035 inch.

6. The insulated container of claim 5, wherein each of said plurality of ribs has a radial thickness, the ratio of said radial thickness to said circumferential width being in the range from about 0.25 to about 4.0.

7. The insulated container of claim 1, wherein said polymeric cup is made from a material selected from a group consisting of polypropylene and polyethylene.

8. The insulated container of claim 1, wherein said circumferential width of each of said plurality of ribs is larger near the top of said polymeric cup.

9. An insulated container for holding food, comprising:

a frustoconical polymeric cup having a side wall with an outer surface, a base connected to a lower portion of said side wall, and a plurality of ribs projecting radially outward from said outer surface of said side wall, said plurality of ribs axially extending substantially along the entire length of said side wall and being distributed around substantially the entire circumference of said side wall, each of said plurality of ribs having a face with a circumferential width and being separated from an adjacent one of said plurality of ribs by a predetermined distance, said predetermined distance being less than approximately 0.100 inch and the ratio of said circumferential width to said predetermined distance being in the range from about 0.15 to about 1.0;

a fibrous sheath having an exterior surface with printed material thereon and an interior surface being connected to at least one of said faces of said plurality of ribs, said exterior surface of said sheath being at least substantially smooth after being attached to said plurality of ribs for displaying said printed material; and a plurality of thermally insulative gaps formed by adjacent ones of said plurality of ribs, said interior surface of said sheath and said outer surface of said side wall.

10. The insulated container of claim 9, wherein said sheath has a thickness in the range from about 0.002 inch to about 0.004 inch, said predetermined distance being approximately 0.050 inch to about 0.060 inch, said circumferential width being in the range from about 0.015 inch to about 0.035 inch.

11. The insulated container of claim 10, wherein each of said plurality of ribs has a radial thickness, the ratio of said radial thickness to said circumferential width being in the range from about 0.25 to about 4.0.

12. The insulated container of claim 9, wherein one of said insulated containers is nestable within another of said insulated containers.

13. The insulated container of claim 9, wherein said face of each of said plurality of ribs is planar.

14. The insulated container of claim 9, said sheath is attached to said plurality of ribs via an adhesive.

15. The insulated container of claim 9, wherein said circumferential width of each of said plurality of ribs is larger near the top of said polymeric cup.

16. A polymeric cup being adapted to hold foods and to receive a sheath thereby forming an insulated container with a substantially smooth exterior surface for displaying printed material, said polymeric cup comprising:

a side wall with an outer surface;

a base connected to a lower portion of said side wall; and a plurality of ribs projecting radially outward from said outer surface of said side wall, said plurality of ribs axially extending substantially along the entire length of said side wall and being distributed around substantially the entire circumference of said side wall, each of said plurality of ribs having a face with a circumferential width and being separated from an adjacent one of said plurality of ribs by a predetermined distance, said predetermined distance being less than approximately 0.060 inch and the ratio of said circumferential width to said predetermined distance being in the range from about 0.2 to about 1.0.

17. The polymeric cup of claim 16, wherein said face of each of said plurality of ribs is planar.

18. The polymeric cup of claim 16, wherein one of said polymeric cups is nestable within another of said polymeric cups.

19. The polymeric cup of claim 16, wherein each of said plurality of ribs has a radial thickness, the ratio of said radial thickness to said circumferential width being in the range from about 0.25 to about 4.0.

20. The polymeric cup of claim 19, wherein said predetermined distance is approximately 0.050 inch and said circumferential width is in the range from approximately 0.015 inch to approximately 0.035 inch.

21. The polymeric cup of claim 16, wherein said polymeric cup is made of a material selected from the group consisting of polypropylene and polyethylene.

22. The polymeric cup of claim 16, wherein said circumferential width of each of said plurality of ribs is larger near the top of said polymeric cup.

* * * * *